United States Patent [19]

Wallin

[11] 4,001,980

[45] Jan. 11, 1977

[54] GRINDING MACHINE

[75] Inventor: Sven-Herman Wallin, Djursholm, Sweden

[73] Assignee: Ambar Investment Inc., Herrliberg, Switzerland

[22] Filed: Aug. 14, 1974

[21] Appl. No.: 497,384

Related U.S. Application Data

[63] Continuation-in-part of Ser. No. 307,370, Nov. 17, 1972, abandoned.

[52] U.S. Cl. ..... 51/165.72

[51] Int. Cl.[2] ..... B24B 49/12

[58] Field of Search ..... 51/165.72, 165.92, 134.5 R

[56] References Cited

UNITED STATES PATENTS

| | | | |
|---|---|---|---|
| 3,178,861 | 4/1965 | Milias | 51/134.5 R X |
| 3,250,043 | 5/1966 | Finkl | 51/134.5 R |
| 3,650,074 | 3/1972 | Weinz | 51/165 R |
| 3,827,190 | 8/1974 | Moriguchi et al. | 51/165.72 X |

FOREIGN PATENTS OR APPLICATIONS

| | | | |
|---|---|---|---|
| 308,871 | 2/1969 | Sweden | 51/281 R |

*Primary Examiner*—Harold D. Whitehead
*Attorney, Agent, or Firm*—Hopgood, Calimafde, Kalil Blaustein and Lieberman

[57] ABSTRACT

The grinding machine of the invention uses a grinding wheel, and is primarily intended for descaling and cleaning billets before being rolled. An instrument for measuring, for instance, electromagnetic radiation is directed to the flow of matter and energy from the contact zone between the grinding wheel and a workpiece. Continuous measurement is performed and an output signal from the instrument is used for changing grinding data of the grinding machine to restore conditions in the flow of matter and energy from the contact zone.

1 Claim, 1 Drawing Figure

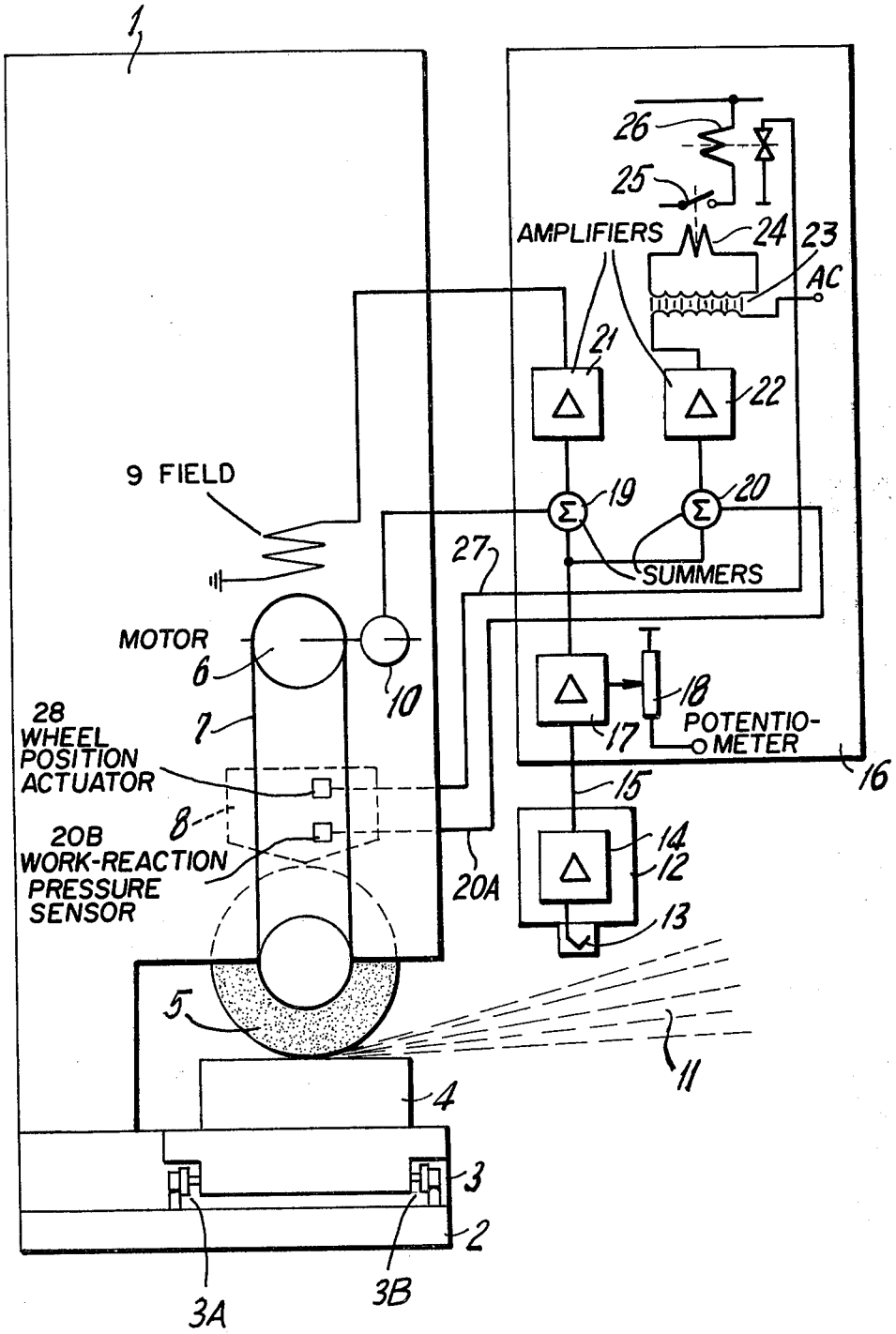
1
26
25
AMPLIFIERS
24
23
AC
21
22
9 FIELD
19
20
27
SUMMERS
MOTOR
6
10
18
POTENTIO-
METER
17
16
28
WHEEL
POSITION
ACTUATOR
7
15
8
20B
WORK-REACTION
PRESSURE
SENSOR
20A
14
12
13
5
11
4
3
2
3A
3B

GRINDING MACHINE

RELATED APPLICATION

This application is a continuation-in-part of application Ser. No. 307,370, filed Nov. 17, 1972, now abandoned.

The invention relates to a grinding machine and method, wherein a grinding wheel is driven by a head motor at adjustable speed and wherein a workpiece is subjected to relative movement in a direction transverse to that of the executed grinding pressure.

One object of the invention is a continuous control and an optimizing of the grinding process to obtain a considerable improvement in cases where it is of importance to keep the shape and the dimensions of a workpiece within narrow limits and where the grinded surfaces of the workpiece must be as perfect as possible and where the possibility of self-sharpening of the grinding wheel must be given.

Another object of the invention is to furnish an automatic control system of the grinding machine with data information regarding the course of events of the grinding process at the very shearing of the material in the contact zone between the grinding wheel and the workpiece material. In this way the grinding parameters can be optimized.

Previously known grinding machines have only been made to keep such parameters at constant values, which could easily lead to great deviations from the desired optima.

The basic idea of the invention if to supervise and control the conversion of energy in the contact zone between the grinding wheel and the workpiece material. In this zone almost all pertinent phenomena are disclosed regarding conversion and distribution of the energy necessary for the shearing, and it will also be possible to control and adjust the shearing work for cutting, the wear of the abrasive grits and the eventual self-sharpening of the grinding wheel. It has not been possible to use hitherto known methods for measuring the flow of matter and energy emanating from the contact zone to satisfy nowadays high demands for controlling a grinding process.

It has been appreciated by the inventor that the energy brought to the grinding process is not only found in the grinding body, in the workpiece material and in the flow of matter from the contact zone, but is also found in the workpiece itself and in parts of the grinding machine and in many cases in the machine bed in the form of energy absorbing vibrations. This is a well known fact and limits the output from a grinding machine used for fettling or rough grinding. A grinding machine according to the invention can be readily controlled to avoid vibrations, as these deteriorate the surface quality of the workpiece, add increased wear to the parts of the grinding machine which may cause breakages of such parts, and cause cracks, unroundness and in some cases breakages of the grinding wheel. Vibrations thus involve a safety risk, and deteriorate industrial hygiene, as they may cause deafness and other physiological and medical discomforts and defects.

In accordance with the invention an improved grinding machine is obtained which comprises, a grinding wheel driven by a head motor at an adjustable speed, said grinding wheel being adjustably mounted to provide variable pressure on a workpiece placed on a machine table transversely movable with respect to the direction of the grinding pressure; means for measuring energy radiating from the flow of grinding matter emanating from the contact zone between the grinding wheel and the workpiece mounted close to said wheel, the energy measured resulting in an output signal; and control means cooperatively associated with said energy measuring means, the output signal of said energy measuring means being fed to said control means arranged for operatively controlling the motor speed, the grinding body pressure and the relative speed between the grinding body and the workpiece, such as to maintain said output signal relatively constant during the grinding operation and thus provide uniform grinding results.

The control procedure of the grinding is carried out by continuously or at a rather high frequency measuring different values being pertinent and characteristic for the result of the process, and by having said values being treated as signals in order to make it possible to adjust and optimize the grinding data partly or in total. Such data are the normal force, i.e. the infeed rate, of the grinding wheel; the cutting speed, i.e. the peripheral speed, of the grinding wheel; the workpiece feed rate, i.e. the rotary or translational movement whereby the relative speed between the grinding wheel and the workpiece is finally defined, and, at the same time, affecting the rate of removal; as well as a possible transverse feed rate.

As the flow of matter and energy emanating from the contact zone contains matter from the workpiece material as well as from the grinding wheel, said last mentioned material will have a significant influence upon the value of the output signal from the means for measuring the energy radiation. Factors influencing this result are the altered wear rate of the abrasive grits, the altered rate of self-sharpening of the grinding wheel, and, especially if grinding takes place with a self-sharpening grinding wheel, the altered cutting geometry of the wheel. A change of the grinding data, the wear rate of the abrasive grits and the rate of self-sharpening will thus mean that other amounts of matter and energy from the grinding wheel will be present in the flow of matter and energy from the contact zone, if not the grinding parameters have been adapted to these actual conditions. In the same way the amount of matter and energy from the grinding wheel will be altered when the cutting geometry is changed, if the grinding data, the wear rate of the abrasive grits and the rate of self-sharpening have not at the same time been accordingly adjusted by the control means.

The flow of matter is also the bearer of much energy, and therefore usually a burning takes place (oxidation) that often leads to a volatilization, and in the extremes to a flaming combustion, as for instance when burning certain bonds used in the grinding body. Such oxidations are exothermic. Oxidations of various kinds emit electromagnetic radiation in both visible and non-visible spectra.

Further, the flow of matter and energy from the contact zone is characterized by both entirely mechanical values, such as mass density or rate of flux, whereby both gradients and mean values of cross sections of the flux are of importance, and also energetical states emitting corpuscular and electro-magnetic radiation of different energy and frequency states.

The means for measuring the energy radiating from the flow of grinding matter from the contact zone can be an energy measuring device, such as a pyrometer or a photometer. Said device should be capable of generating an output signal. Such a signal will, in essence, represent the sum total of all the characteristics of the grinding conditions prevailing in the grinding zone.

The invention will be further described in connection with the accompanying drawing, diagrammatically showing one embodiment of the invention.

On the drawing is shown a grinding machine 1 resting on a bed plate 2. The grinding machine comprises a machine table 3 movable in transverse directions in the plane of the drawing, for example, on rolls and tracks arrangement 3A, 3B as shown. A workpiece 4 is placed on the machine table and may be a stainless steel billet from which the oxide skin shall be removed before milling in a rolling mill. The workpiece is secured to the machine table and follows its movements. The grinding process is executed by means of a grinding wheel 5 driven by a head motor 6 by means of suitable transmission means 7, such as a driver. In order to be able to adjust the grinding pressure, means 8 as indicated by a symbolic arrow is arranged to influence the pressure of the driving unit. The head motor 6 has a field winding 9, and a tachometer generator 10 is driven by the motor to supply a voltage depending on the number of revolutions of the motor.

From the contact zone between the grinding wheel 5 and the workpiece 4 a flow of matter and energy is emanating and is indicated by 11. In order to measure the energy in said flow a measuring device 12 is arranged and aimed at a point of measuring as close to the contact zone as possible where the energy density is great and where the measurement can take place without disturbances. The measuring device 12 should be mounted in a plane at right angles to the axis of rotation of the grinding body, constituting a symmetry plane of the cross section of the flow of matter and energy from the contact zone. The measuring device 12 must be mounted free of vibrations and at such a distance from the contact zone as to make the linear wear of the grinding body not injuriously affecting the accuracy of the measuring. In order to comply with the requirements of the invention the measuring device may utilize a pyrometer 13 giving via a suitable amplifier 14 an output signal on an output conductor 15.

When using a pyrometer or a photometer the temperature in the flow of matter and energy is measured. In this way the shearing work of the grinding wheel 5 is measured, as the emission in said flow is uniquely dependent on the shearing work.

It should be observed that even other characteristic data from the flow of matter and energy could be measured and used for providing an output signal from the measuring device.

A control unit 16 comprises circuit arrangements for providing the desired control of the grinding process. By way of example a schematic circuitry is shown for controlling the field of the head motor 6 and for controlling the grinding pressure.

The output signal on the conductor 15 is fed to an amplifier 17 provided with means 18 for setting a reference value. An amplified signal is fed to two summers 19 and 20. Summer 19 also receives a comparison voltage from the tachometer generator 10 and the sum of said signals is amplified in an amplifier 21 and is supplied to the motor field 9 for setting the field current.

Summer 20 also receives a comparison voltage from the pressure control unit 8. In this unit may be incorporated means for diameter compensation of the grinding wheel, controlled, for instance, by a capacitive transmitter indicating the wear of the grinding wheel. In the present case the comparison voltage to represents a signal indicating the actual wheel pressure as well as the diameter value. Known work-reaction pressure sensor 20B is employed coupled via line 20A to summer 20. The output signal from the summer 20 is amplified in an amplifier 22 and fed to a relay 24 via a transformer means 23. A contact 25 of said relay 24 is used to operate, via an auxiliary relay 26, a solenoid valve for increasing or decreasing the grinding pressure. Said valve is shown near the relay 26, but is intended to be situated in the pressure control unit 8. Known wheel position actuator 28 as shown schematically which is responsive to relay 26 via line 27 for positioning the wheel in grinding relationship to work-piece 4.

The means 18 for setting a reference value for the grinding process may be a potentiometer. By means of this potentiometer a reference temperature may be set. During operation an increase of temperature in the flow of matter and energy 11 will cause the grinding pressure to be decreased until the temperature measured will correspond to the value set by the potentiometer 18. Simultaneously, the continuous wear of the grinding wheel will be compensated by the control of the motor field 9 until the correct temperature value in said flow is reached.

In the described case the speed of the machine table 4 is not being controlled, and is supposed to be set at a maximum value.

The most important means of control is to vary the speed of the grinding wheel is connection with a variation of the grinding pressure, in both cases utilizing feed back signals. In this way it is possible to use a non-contact measuring instrument, as for instance a pyrometer, for the control equipment of the grinding machine, making it possible, as the main advantage of the invention, to optimize the control process of the grinding.

What is claimed is:

1. A grinding machine for skin-grinding the surface of a metal workpiece, comprising:

a machine frame and work-supporting means carried thereby, a grinding wheel and frame-referenced feed means for movably positioning said wheel with respect to an exposed surface of a metal workpiece supported by said work-supporting means, driving means for continuously rotating said grinding wheel, traversing means for traversing said wheel and work-supporting means with respect to each other, whereby a flow of grinding matter will emanate in essentially a single direction of discharge away from the instantaneous zone of grinding contact with the workpiece in the course of a cutting traverse, said flow near the grinding region being characterized by radiant energy of magnitude indicative of the instantaneous depth of local grinding cut into the exposed surface of the workpiece, radiant-energy responsive means positioned in offset adjacent to said flow and producing an electrical signal output proportional to the instantaneously detected radiant-energy level in said flow near the grinding region, and control means responsively connected to said radiant-energy responsive means and operatively connected to said feed means for continuously positioning said grinding wheel with respect to the instantaneously ground workpiece region such that the radiant energy in said flow is maintained at a substantially constant level as evidenced by a substantially constant output signal produced by said radiant-energy responsive means in the course of a cutting traverse, whereby the exposed surface of the workpiece is skinned to an essentially constant predetermined depth of cut.

* * * * *